US011008970B2

(12) United States Patent
Nishida et al.

(10) Patent No.: US 11,008,970 B2
(45) Date of Patent: May 18, 2021

(54) CONTROL DEVICE FOR ENGINE

(71) Applicant: Mazda Motor Corporation, Hiroshima (JP)

(72) Inventors: Masami Nishida, Hiroshima (JP); Toru Miyamae, Hiroshima (JP); Shigeki Yamashita, Aki-gun (JP); Kazuhiro Takemoto, Hiroshima (JP); Michio Ito, Hatsukaichi (JP); Kazuhiro Nishimura, Higashihiroshima (JP); Yusuke Kawai, Hiroshima (JP); Tetsuya Chikada, Higashihiroshima (JP); Tatsuhiro Tokunaga, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/922,886

(22) Filed: Jul. 7, 2020

(65) Prior Publication Data

US 2021/0017929 A1 Jan. 21, 2021

(30) Foreign Application Priority Data

Jul. 17, 2019 (JP) ..... JP2019-131949

(51) Int. Cl.
*F02D 41/30* (2006.01)
*F02B 5/02* (2006.01)
(Continued)

(52) U.S. Cl.
CPC ..... *F02D 41/3017* (2013.01); *F02B 5/02* (2013.01); *F02B 9/04* (2013.01); *F02D 1/02* (2013.01);
(Continued)

(58) Field of Classification Search
CPC .. F02D 41/3017; F02D 41/3845; F02D 41/40; F02D 1/02; F02D 2001/009;
(Continued)

(56) References Cited

U.S. PATENT DOCUMENTS

2003/0230276 A1* 12/2003 Kataoka ..... F02M 26/33 123/295
2010/0082223 A1* 4/2010 Toyohara ..... F02D 41/3845 701/103
2014/0000568 A1* 1/2014 Nishida ..... F02D 41/20 123/490

FOREIGN PATENT DOCUMENTS

JP 2002213326 A 7/2002
JP 2006037815 A 2/2006

* cited by examiner

*Primary Examiner* — Mahmoud Gimie
(74) *Attorney, Agent, or Firm* — Alleman Hall Creasman & Tuttle LLP

(57) ABSTRACT

A control device for controlling an engine provided with a fuel pump including a pressurizing chamber, a plunger inserted into the pressurizing chamber and which changes a volume of the pressurizing chamber, and an on-off valve configured to open and close a suction port, is provided. When a pressurizing cycle consists of a period of pressurizing stroke in which the volume of the pressurizing chamber is reduced to allow fuel to be pressurized and a period of suction stroke in which the volume of the pressurizing chamber is increased to allow fuel to be drawn into the pressurizing chamber, a closing cycle of the on-off valve is controlled so that a ratio of the closing cycle to the pressurizing cycle becomes smaller in a second combustion mode where a partial compression-ignition combustion is performed than in a first combustion mode where SI combustion is performed.

5 Claims, 10 Drawing Sheets

(51) Int. Cl.

| | |
|---|---|
| ***F02B 9/04*** | (2006.01) |
| ***F02D 1/02*** | (2006.01) |
| ***F02D 41/38*** | (2006.01) |
| ***F02D 41/40*** | (2006.01) |
| ***F02M 59/02*** | (2006.01) |
| ***F02M 59/10*** | (2006.01) |
| ***F02M 59/46*** | (2006.01) |
| *F02D 1/00* | (2006.01) |

(52) U.S. Cl.
CPC ..... *F02D 41/3845* (2013.01); *F02D 41/40* (2013.01); *F02M 59/025* (2013.01); *F02M 59/10* (2013.01); *F02M 59/46* (2013.01); *F02D 2001/009* (2013.01); *F02D 2041/389* (2013.01)

(58) Field of Classification Search
CPC ..... F02D 2041/389; F02B 5/02; F02B 9/04; F02M 59/025; F02M 59/10; F02M 59/46
USPC ..... 123/294
See application file for complete search history.

CONTROL DEVICE FOR ENGINE

TECHNICAL FIELD

The present disclosure relates to a control device for an engine provided with a fuel injector which supplies fuel to a cylinder, a spark plug which ignites a mixture gas inside the cylinder, a fuel storage which stores fuel to be introduced into the fuel injector, a fuel pump which pumps fuel to the fuel storage, and a low-pressure fuel passage thorough which fuel to be introduced into the fuel pump flows.

BACKGROUND OF THE DISCLOSURE

Engines may be provided with a fuel storage which stores fuel to be introduced into a fuel injector, and a fuel pump which pumps fuel into the fuel storage. The fuel pump may include a pressurizing chamber inside thereof and pressurize fuel by changing a volume of the pressurizing chamber.

For example, JP2002-213326A discloses a fuel pump including a plunger which changes a volume of a pressurizing chamber by being inserted into the chamber, and moving in an up-and-down direction. Such a fuel pump is provided with an on-off valve at a suction port of the pressurizing chamber for opening and closing the suction port. Fuel is drawn in when the on-off valve is open, and is pressurized when it is closed.

In the fuel pump which changes the volume of the pressurizing chamber by the plunger inserted into the pressurizing chamber as described above, the pressurized fuel may leak outside the pressurizing chamber from a gap between the plunger and a part accommodating the plunger, and the leaked fuel may be reintroduced into the pressurizing chamber and pressurized, which may lead to an excessive rise in temperature of the fuel. In this regard, for example, it may be considered to reduce a frequency of fuel being pressurized in the fuel pump. However, in this case, a pressure of fuel supplied to the fuel storage and the fuel injector, and accuracy of controlling the injection pressure of the fuel injector may decrease.

Here, in order to improve fuel efficiency, it has been examined to combust a mixture gas by a partial compression-ignition combustion. The partial compression-ignition combustion is a combustion mode in which a portion of the mixture gas is combusted by self-ignition, which can improve fuel efficiency by shortening a combustion period. However, a timing of the self-ignition of the mixture gas is easily influenced by a state of the mixture gas and a gas flow inside a combustion chamber. Therefore, if the injection pressure of the fuel injector deviates from an appropriate pressure, and a state of fuel spray and the gas flow inside the combustion chamber change, the timing of the self-ignition may largely deviate from an appropriate timing. Thus, if the frequency of fuel being pressurized by the fuel pump is reduced as described above in the partial compression-ignition combustion mode, the partial compression-ignition combustion may not be achieved appropriately.

SUMMARY OF THE DISCLOSURE

The present disclosure is made in view of the above situations, and aims to provide a control device for an engine in which a partial compression-ignition combustion is performed, which can achieve an appropriate partial compression-ignition combustion while preventing an excessive rise in temperature of fuel.

According to one aspect of the present disclosure, a control device for controlling an engine is provided. The engine is provided with a fuel injector configured to inject fuel into a cylinder, a spark plug configured to ignite a mixture gas inside the cylinder, a fuel storage configured to store fuel to be introduced into the fuel injector, a fuel pump configured to pump fuel into the fuel storage, and a low-pressure fuel passage through which fuel to be introduced into the fuel pump flows. The control device includes a processor configured to execute a combustion controller to switch a combustion mode of the mixture gas between a first combustion mode and a second combustion mode by controlling each component of the engine according to an operating state of the engine, and a pump controller to control the fuel pump. In the first combustion mode, the mixture gas is combusted by spark ignition (SI) combustion where the spark plug ignites the mixture gas, and in the second combustion mode, a portion of the mixture gas is combusted by the SI combustion where the spark plug ignites the mixture gas, and then the remaining mixture gas is combusted by compression ignition (CI) combustion where the mixture gas is combusted by self-ignition. The fuel pump includes a pressurizing chamber having a suction port, and into which fuel is introduced from the low-pressure fuel passage via the suction port, a plunger inserted into the pressurizing chamber and configured to change a volume of the pressurizing chamber, an on-off valve configured to open and close the suction port, and a plunger driving part configured to drive the plunger interlocking with the engine so that a suction stroke in which the volume of the pressurizing chamber is increased to allow fuel to be drawn into the pressurizing chamber, and a pressurizing stroke in which the volume of the pressurizing chamber is reduced to allow fuel inside the pressurizing chamber to be pressurized, are performed successively. When assuming that a period of time combining a period of the pressurizing stroke and a period of the suction stroke is a pressurizing cycle, the pump controller cyclically closes the on-off valve, and controls a closing cycle of the on-off valve so that a ratio of the closing cycle of the on-off valve to the pressurizing cycle becomes smaller in the second combustion mode than in the first combustion mode.

In this configuration, when assuming that the period of time combining the period of the pressurizing stroke and the period of the suction stroke is the pressurizing cycle, the closing cycle of the on-off valve is controlled so that the ratio of the closing cycle of the on-off valve to the pressurizing cycle becomes smaller in the second combustion mode where the partial compression-ignition combustion in which the portion of the mixture gas self-ignites is performed than in the first combustion mode where SI combustion is performed. Thus, in the SI combustion, the frequency of the on-off valve being closed relative to a given number of the pressurizing strokes is reduced, thus the frequency of closing the on-off valve is reduced. For example, the on-off valve is intermittently opened and closed with respect to the pressurizing stroke so that the on-off valve is closed only once to a plurality of pressurizing strokes. On the other hand, in the partial compression-ignition combustion, the frequency of the on-off valve being closed relative to a given number of the pressurizing stroke is increased, thus the frequency of closing the on-off valve is increased. For example, the on-off valve is opened once per pressurizing stroke.

Thus, in the SI combustion, the frequency of the fuel being pressurized in the pressurizing chamber according to the closing of the on-off valve, and further, the frequency of the pressurized fuel leaked outside the pressurizing chamber being reintroduced into the pressurizing chamber can be reduced. Therefore, an excessive rise in the fuel temperature can be prevented. Moreover, in the partial compression-ignition combustion which is easily influenced by the state of the mixture gas and gas flow inside a combustion chamber, the frequency of the fuel being pressurized is increased so that an accuracy of controlling the injection pressure of the fuel injector improves. Thus, in the partial compression-ignition combustion, a state of fuel spray injected by the fuel injector, and the state of the mixture gas and the gas flow inside the combustion chamber can accurately be made more appropriate so that the appropriate partial compression-ignition combustion can be achieved.

The combustion controller may control the fuel injector so that an air-fuel ratio of mixture gas in the second combustion mode becomes larger than a stoichiometric air-fuel ratio.

According to this configuration, since the air-fuel ratio of the mixture gas is made larger than the stoichiometric air-fuel ratio (i.e., lean), fuel efficiency in the second combustion mode can be improved more compared to when the air-fuel ratio is made less than the stoichiometric air-fuel ratio. Note that if the air-fuel ratio of the mixture gas is made leaner than the stoichiometric air-fuel ratio, the combustion stability degrades. Thus, an influence of changes in the state of fuel spray and the gas flow inside the combustion chamber on the combustion state of the mixture gas increases. In this regard, according to this configuration, since the injection pressure of the fuel injector is certainly maintained appropriately in the second combustion mode as described above, an appropriate partial compression-ignition combustion can be achieved while making the air-fuel ratio of the mixture gas leaner than the stoichiometric air-fuel ratio.

The pump controller may set a target variation width that is a target value for a variation width of fuel pressure inside the fuel storage, and control the closing cycle of the on-off valve so that the variation width becomes the target variation width. The target variation width may be set to a smaller value in the second combustion mode than in the first combustion mode.

According to this configuration, in the second combustion mode where the partial compression-ignition combustion is performed, the variation of the injection pressure of the fuel injector is reduced to be an appropriate pressure more certainly. Thus, the appropriate partial compression-ignition combustion can be achieved more certainly. On the other hand, in the first combustion mode where the SI combustion is performed, the closing cycle of the on-off valve is controlled so that the variation width of fuel pressure inside the fuel storage becomes larger. Thus, the ratio of the closing cycle of the on-off valve to the pressurizing cycle can be increased so that the excessive rise in the fuel temperature can be prevented.

Here, in the second combustion mode, it is known that when the engine load is high, a change in the amount of $NO_x$ emitted from the engine becomes larger as the change in the injection pressure of the fuel injector becomes larger, which may degrade exhaust performance.

According to this, in the second combustion mode, the target variation width may be set to a smaller value as an engine load increases.

Thus, the degradation of exhaust performance can be prevented, and in the second combustion mode and when the engine load is lower, the frequency of the on-off valve being closed is reduced (within a range more than those in the first combustion mode) so that the excessive rise in the fuel temperature can be prevented.

According to another aspect of the present disclosure, a method for controlling an engine is provided. The engine is provided with a fuel injector configured to inject fuel into a cylinder, a spark plug configured to ignite a mixture gas inside the cylinder, a fuel storage configured to store fuel to be introduced into the fuel injector, a fuel pump configured to pump fuel into the fuel storage, and a low-pressure fuel passage through which fuel to be introduced into the fuel pump flows. The method includes the step of switching a combustion mode of the mixture gas between a first combustion mode and a second combustion mode by controlling each component of the engine according to an operating state of the engine. The method includes the step of controlling the fuel pump. In the first combustion mode, the mixture gas is combusted by spark ignition (SI) combustion where the spark plug ignites the mixture gas, and in the second combustion mode, a portion of the mixture gas is combusted by the SI combustion where the spark plug ignites the mixture gas, and then the remaining mixture gas is combusted by compression ignition (CI) combustion where the mixture gas is combusted by self-ignition. The fuel pump includes a pressurizing chamber having a suction port, and into which fuel is introduced from the low-pressure fuel passage via the suction port, a plunger inserted into the pressurizing chamber and configured to change a volume of the pressurizing chamber, an on-off valve configured to open and close the suction port, and a plunger driving part configured to drive the plunger interlocking with the engine so that a suction stroke in which the volume of the pressurizing chamber is increased to allow fuel to be drawn into the pressurizing chamber, and a pressurizing stroke in which the volume of the pressurizing chamber is reduced to allow fuel inside the pressurizing chamber to be pressurized, are performed successively. When assuming that a period of time combining a period of the pressurizing stroke and a period of the suction stroke is a pressurizing cycle, the on-off valve is cyclically closed, and a closing cycle of the on-off valve is controlled so that a ratio of the closing cycle of the on-off valve to the pressurizing cycle becomes smaller in the second combustion mode than in the first combustion mode.

DETAILED DESCRIPTION OF THE DISCLOSURE (1) Overall Configuration of Engine

Figure 1:
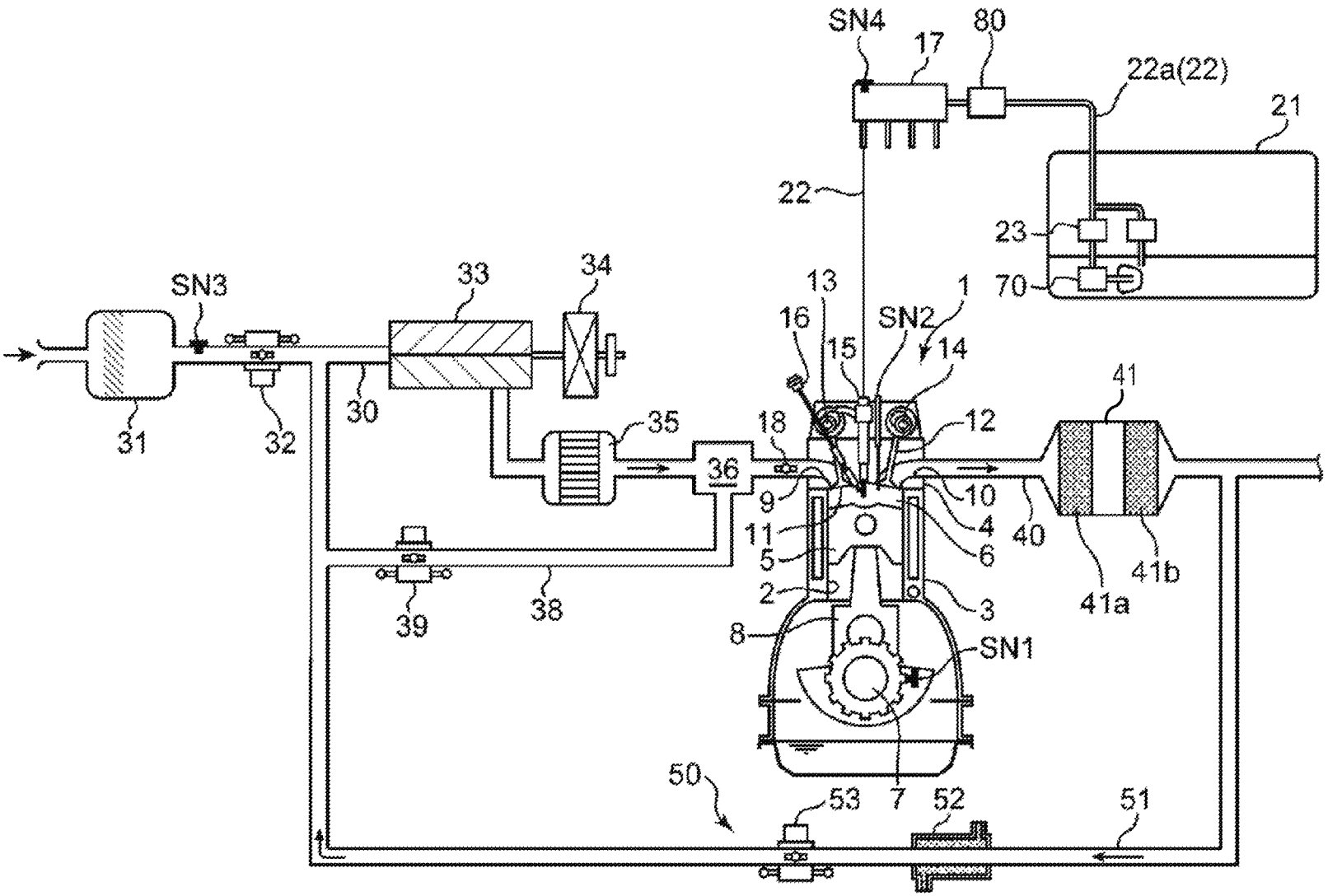
FIG. 1 is a system diagram schematically illustrating an overall configuration of an engine according to one embodiment of the present disclosure.

FIG. 1 is a system diagram schematically illustrating an overall configuration of an engine to which a control device for an engine of the present disclosure is applied. The engine system illustrated in FIG. 1 is mounted on a vehicle and includes an engine body 1 serving as a propelling source. In this embodiment, a four-cycle, direct injection gasoline engine is used as the engine body 1. The engine system includes, in addition to the engine body 1, an intake passage 30 through which intake air to be introduced into the engine body 1 flows, an exhaust passage 40 through which exhaust gas discharged from the engine body 1 flows, and an exhaust gas recirculation (EGR) device 50 which recirculates a portion of the exhaust gas flowing through the exhaust passage 40 to the intake passage 30.

The engine body 1 has a cylinder block 3 in which cylinders 2 are formed, a cylinder head 4 attached to an upper surface of the cylinder block 3 so as to cover the cylinders 2 from above, and pistons 5 reciprocatably inserted into each cylinder 2. Although the engine body 1 is of a multi-cylinder type having a plurality of cylinders 2, here, the description may be given regarding only one of the cylinders 2 for the sake of simplicity.

A combustion chamber 6 is defined above each piston 5, and fuel containing gasoline as a main component is injected into the combustion chamber 6 by an injector 15 (described later). Then, the supplied fuel is combusted while being mixed with air inside the combustion chamber 6, and an expansion force caused by the combustion pushes down the piston 5 so that the piston 5 reciprocates in the vertical direction of the cylinder 2. Note that for fuel injected into the combustion chamber 6, fuel containing gasoline as the main component is used. The fuel may contain a subcomponent, such as bioethanol, in addition to gasoline. In this embodiment, the injector 15 is an example of a "fuel injector" of the present disclosure.

A crankshaft 7, which is an output shaft of the engine body 1, is provided below the pistons 5. The crankshaft 7 is connected to the pistons 5 via connecting rods 8 and rotates about its center axis according to the reciprocation (up-and-down motion) of the pistons 5. The cylinder block 3 is provided with a crank angle sensor SN1 which detects a rotational angle of the crankshaft 7 (crank angle) and a rotational speed of the crankshaft 7 (engine speed).

A geometric compression ratio of the cylinder 2, that is, a ratio of a volume of the combustion chamber 6 when the piston 5 is at a top dead center (TDC) to a volume of the combustion chamber 6 when the piston 5 is at a bottom dead center (BDC), is set as 13:1 or higher and 30:1 or lower as a suitable value for SPCCI combustion (partial compression-ignition combustion) described later. In detail, the geometric compression ratio of the cylinder 2 is set as 14:1 or higher and 17:1 or lower when using regular gasoline of which an octane number is about 91, and set as 15:1 or higher and 18:1 or lower when using high octane gasoline of which the octane number is about 96.

In this embodiment, the engine body 1 is a four-cylinder engine having four cylinders 2 lined up in a direction perpendicular to the drawing sheet of FIG. 1, and configured so that an expansion (combustion of a mixture gas) occurs in two cylinders 2 during one rotation of the crankshaft 7. That is, in this embodiment, a combustion cycle, which is a period of time from an expansion in a given cylinder 2 to an expansion in the next cylinder 2, is 180° CA (° CA: crank angle). When the four cylinders 2 are a first cylinder, a second cylinder, a third cylinder, and a fourth cylinder from one side in the lined-up direction, an expansion (combustion of the mixture gas) in each cylinder 2 occurs in the order of the first cylinder, the third cylinder, the fourth cylinder, and then the second cylinder. After the second cylinder, the expansion occurs again in the first cylinder and repeats in this order.

The cylinder head 4 includes intake ports 9 and exhaust ports 10 which open to each combustion chamber 6, intake valves 11 which open and close respective intake ports 9, and exhaust valves 12 which open and close respective exhaust ports 10. Note that a valve type of the engine in this embodiment is a four-valve type including two intake valves and two exhaust valves. Two intake ports 9, two exhaust ports 10, two intake valves 11, and two exhaust valves 12 are provided to each cylinder 2. The intake valves 11 and the exhaust valves 12 are driven to open and close interlocked with the rotation of the crankshaft 7, by valve operating mechanisms 13 and 14 including a pair of camshafts disposed in the cylinder head 4. In this embodiment, a swirl valve 18 is provided to one of the two intake ports 9 connected to each cylinder 2 to be changeable of intensity of a swirl flow inside the cylinder 2 (a circling flow around the axis of the cylinder).

The cylinder head 4 is provided with injectors 15 each of which injects fuel (mainly gasoline) into the corresponding combustion chamber 6, and spark plugs 16 each of which ignites the mixture gas containing the fuel injected from the corresponding injector 15 and air introduced into the corresponding combustion chamber 6. The cylinder head 4 is further provided with in-cylinder pressure sensors SN2 each of which detects an in-cylinder pressure which is pressure inside the corresponding combustion chamber 6.

Each injector 15 is a multi-port injector having a plurality of nozzle holes at its tip portion, and capable of injecting fuel radially from the plurality of nozzle holes. Each injector 15 is provided so that its tip portion opposes to a center portion of a crown surface of the corresponding piston 5. Note that in this embodiment, on the crown surface of the piston 5, a cavity is formed by denting an area including the center portion to the opposite side of the cylinder head 4 (downward). Each spark plug 16 is disposed at a position somewhat offset to the intake side with respect to the corresponding injector 15.

The injectors 15 are connected to a fuel tank 21 via a fuel supplying passage 22 so that fuel is supplied from the fuel tank 21 to the injectors 15.

The fuel supplying passage 22 is provided with a low-pressure pump 70, a fuel filter 23, a high-pressure pump 80, and a fuel rail 17, in this order from an upstream side (a fuel tank side, that is, the opposite side of the injectors 15). The low-pressure pump 70 and the high-pressure pump 80 are both pumps which pump fuel. The fuel filter 23 is a filter which removes foreign matters contained in fuel. The fuel rail 17 is a member which stores high-pressure fuel. The high-pressure pump 80 is an example of a "fuel pump," and the fuel rail 17 is an example of a "fuel storage" in the present disclosure.

The fuel stored in the fuel tank 21 is pumped to the high-pressure pump 80 by the low-pressure pump 70. During this pumping, a part of the foreign matters in the fuel is removed by the fuel filter 23. The fuel after passing through the fuel filter 23 is further pressurized by the high-pressure pump 80, and pumped to the fuel rail 17. The fuel pumped from the high-pressure pump 80 is stored in the fuel rail 17. The injectors 15 are connected to the fuel rail 17 so that the fuel is distributed to each injector 15 from the fuel rail 17. A detailed structure of the high-pressure pump 80 will be described later.

The fuel rail 17 is provided with a rail pressure sensor SN4 which detects pressure of fuel stored in the fuel rail 17 (this pressure of fuel inside the fuel rail 17 is suitably referred to as a "rail pressure").

The intake passage 30 is connected to one side surface of the cylinder head 4 so as to communicate with the intake ports 9. Air (intake air, fresh air) taken in from an upstream end of the intake passage 30 is introduced into each combustion chamber 6 through the intake passage 30 and the corresponding intake port 9.

In the intake passage 30, an air cleaner 31 which removes foreign matters contained in the intake air to be introduced into the combustion chamber 6, a throttle valve 32 which opens and closes the intake passage 30, a supercharger 33 which boosts the intake air, an intercooler 35 which cools the intake air compressed by the supercharger 33, and a surge tank 36 are provided in this order from the upstream side. An airflow sensor SN3 is provided in a portion of the intake passage 30 between the air cleaner 31 and the throttle valve 32, and detects an intake air amount which is a flow rate of the intake air passing through this portion.

The supercharger 33 is a mechanical supercharger which is mechanically linked to the engine body 1. Although the specific type of the supercharger 33 is not particularly limited, any of known superchargers, such as Lysholm type, Roots type, or centrifugal type, may be used as the supercharger 33. An electromagnetic clutch 34 which is electrically switchable of its operation mode between "engaged" and "disengaged" is provided between the supercharger 33 and the engine body 1. When the electromagnetic clutch 34 is engaged, a driving force is transmitted from the engine body 1 to the supercharger 33, and therefore, the supercharger 33 boosts the engine. On the other hand, when the electromagnetic clutch 34 is disengaged, the driving force is interrupted, and therefore, the boosting by the supercharger 33 is suspended.

A bypass passage 38 which bypasses the supercharger 33 is provided in the intake passage 30. The bypass passage 38 connects the surge tank 36 and an EGR passage 51 (described later). A bypass valve 39 is provided in the bypass passage 38. The bypass valve 39 adjusts pressure of intake air to be introduced into the surge tank 36, that is, the boosting pressure. For example, as an opening of the bypass valve 39 increases, the flow rate of intake air passing through the bypass passage 38 increases, and therefore, the boosting pressure decreases.

The exhaust passage 40 is connected to the other side surface of the cylinder head 4 so as to communicate with the exhaust ports 10. Burnt gas (exhaust gas) generated inside each combustion chamber 6 is discharged outside through the corresponding exhaust port 10 and the exhaust passage 40. The exhaust passage 40 is provided with a catalytic converter 41. In the catalytic converter 41, a three-way catalyst 41*a* which purifies hazardous components (HC, CO, and NOR) contained in the exhaust gas, and a GPF (Gasoline Particulate Filter) 41*b* which captures particulate matters (PM) contained in the exhaust gas are built, in this order from the upstream side.

The EGR device 50 has the EGR passage 51, and an EGR cooler 52 and an EGR valve 53 which are provided in the EGR passage 51. The EGR passage 51 connects the exhaust passage 40 downstream of the catalytic converter 41 to a portion of the intake passage 30 between the throttle valve 32 and the supercharger 33. The EGR cooler 52 cools, by a heat exchange, exhaust gas recirculated from the exhaust passage 40 to the intake passage 30 through the EGR passage 51 (EGR gas). The EGR valve 53 is provided in the EGR passage 51 downstream of the EGR cooler 52 (the intake passage 30 side), and adjusts a flow rate of exhaust gas flowing through the EGR passage 51.

(2) High-Pressure Pump

Figure 2:
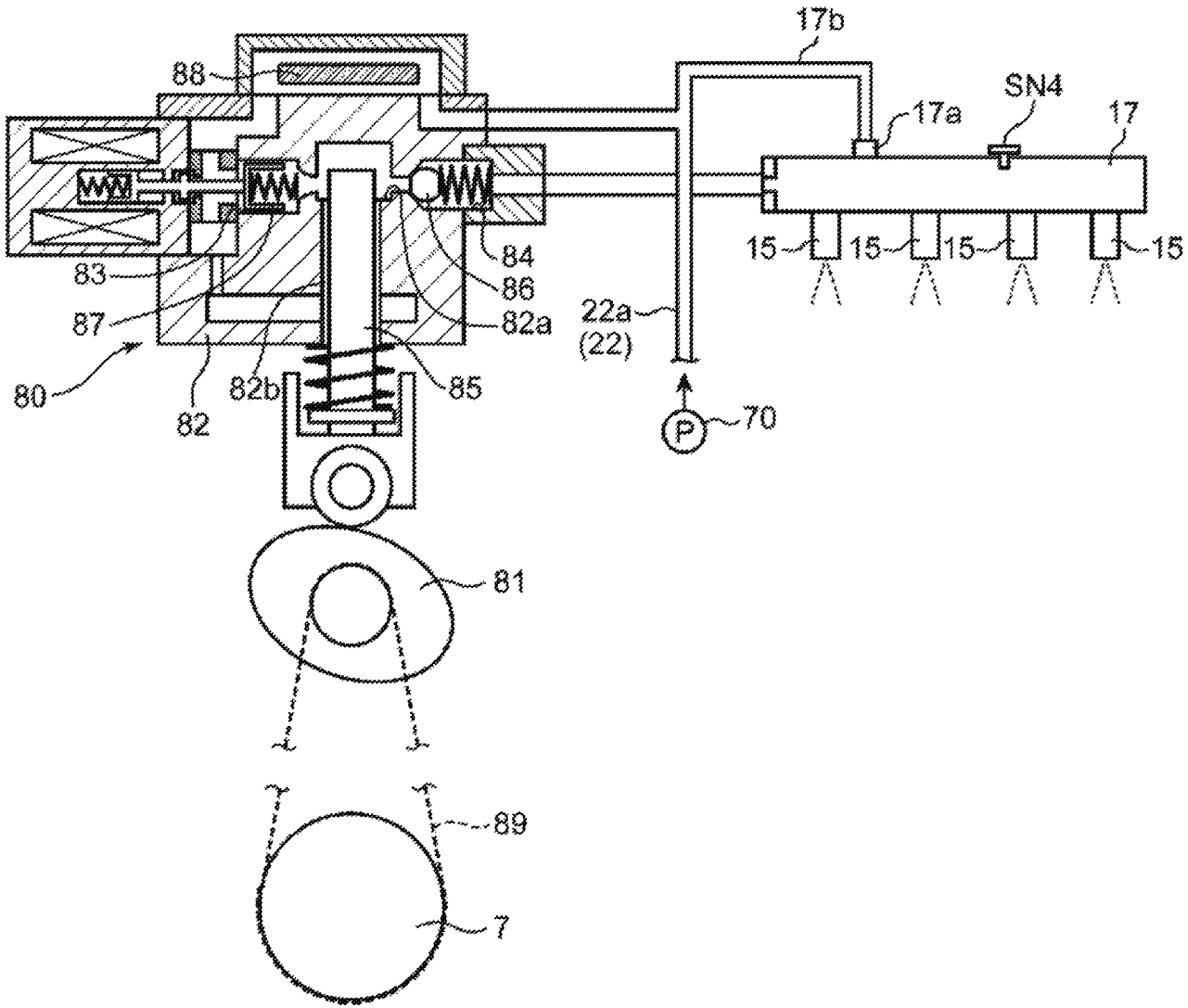
FIG. 2 is a view schematically illustrating a configuration around a high-pressure pump.

FIG. 2 is a view schematically illustrating a configuration around the high-pressure pump 80. The high-pressure pump 80 is of a reciprocating type. The high-pressure pump 80 includes a body part 82 in which a pressurizing chamber 82*a* for pressurizing fuel is formed, a plunger 85 disposed inside a plunger sliding part 82*b* which is formed inside the body part 82, and a high-pressure pump cam 81 which drives the plunger 85. A tip end of the plunger 85 is inserted into the pressurizing chamber 82*a*. In the body part 82, a suction port 83 is formed. The suction port 83 communicates with a low-pressure fuel passage 22*a*, which is a portion of the fuel supplying passage 22 between the low-pressure pump 70 and the high-pressure pump 80, and introduces fuel pumped from the low-pressure pump 70 into the pressurizing chamber 82*a*. In the body part 82, a pulsation dumper 88 which reduces fuel pulsations is provided between the low-pressure fuel passage 22*a* and the suction port 83. Further, a discharging port 84 is formed in the body part 82. The discharging port 84 communicates with the fuel rail 17, and discharges fuel from the pressurizing chamber 82*a* to the fuel rail 17. The suction port 83 is provided with a spill valve 87 which opens and closes the suction port 83. The spill valve 87 is an electromagnetic valve of a normally opened type, and it closes when power is supplied so that the suction port 83 is closed. A check valve 86 is provided to the discharging port 84 so that a backflow of fuel from a fuel rail 17 side to a high-pressure pump 80 side is regulated. Moreover, fuel is supplied from the high-pressure pump 80 to the fuel rail 17 when pressure of the fuel inside the pressurizing chamber 82*a* exceeds a given value. The spill valve 87 is an example of an "on-off valve," and the high-pressure pump cam 81 is an example of a "plunger driving part" of the present disclosure.

The plunger 85 is disposed above the high-pressure pump cam 81 so as to contact directly with the high-pressure pump cam 81. The plunger 85 changes a volume of the pressurizing chamber 82*a* (a volume of a space defined above the tip end of the plunger 85) by reciprocating in the up-and-down direction accompanying a rotation of the high-pressure pump cam 81. In detail, the volume of the pressurizing chamber 82*a* increases as the plunger 85 moves downwardly, and thus, fuel is drawn in from the suction port 83 into the pressurizing chamber 82*a*. The volume of the pressurizing chamber 82*a* decreases as the plunger 85 moves upwardly, and thus fuel, inside the pressurizing chamber 82*a* can be pressurized. As described above, by the reciprocation of the plunger 85, the high-pressure pump 80 performs a suction stroke and a pressurizing stroke. On the suction stroke, the volume of the pressurizing chamber 82*a* increases over time and fuel can be drawn into the pressurizing chamber 82*a*, while on the pressurizing stroke, the volume of the pressurizing chamber 82*a* decreases over time and fuel inside the pressurizing chamber 82*a* can be pressurized. By the plunger 85 continuously reciprocating, these strokes are performed continuously.

The high-pressure pump cam 81 is driven by the engine body 1 so that the high-pressure pump cam 81 drives the plunger 85 by rotating in conjunction with the engine body 1. In detail, the high-pressure pump cam 81 is connected with the crankshaft 7 via a chain 89, and rotates accompanying the rotation of the crankshaft 7. In this embodiment, the high-pressure pump cam 81 is a double-lobe cam, and the plunger 85 reciprocates twice during one rotation of the crankshaft 7. That is, assuming a reciprocation cycle of the plunger 85, or a period combining the suction stroke period and the pressurizing stroke period (a period from a start of one suction stroke to a start of the next suction stroke) is a pressurizing cycle of the high-pressure pump 80, the pressurizing cycle of the high-pressure pump 80 is set to 180° CA. In this embodiment, as described above, the mixture gas combusts and an expansion occurs in any one of the cylinders 2 in every 180° CA, and thus, the combustion cycle of the engine matches with the pressurizing cycle of the high-pressure pump 80.

As described above, in the pressurizing stroke, fuel inside the pressurizing chamber 82*a* is pressurized as the volume of the pressurizing chamber 82*a* decreases. However, when the spill valve 87 opens so as to open the suction port 83, since fuel inside the pressurizing chamber 82*a* is pushed back toward the low-pressure fuel passage 22*a* from the suction port 83, the fuel is hardly pressurized. That is, the pressurizing of fuel inside the pressurizing chamber 82*a*, and thus, the pressurizing of fuel inside the fuel rail 17 occur only when the pressurizing chamber 82*a* is on the pressurizing stroke and the spill valve 87 closes. The pressurization period of fuel inside the pressurizing chamber 82*a* increases as a closing period of the spill valve 87 (a period from a start to an end of the closing of the spill valve 87) increases, which increases a pressurizing amount of the fuel. Note that when the spill valve 87 closes, the spill valve 87 starts closing during the pressurizing stroke, and ends the closing and starts opening as the suction stroke starts.

The fuel rail 17 is separately connected to the fuel supplying passage 22 via a return passage 17*b*, and a relief valve 17*a* which opens and closes the return passage 17*b*. Excess fuel inside the fuel rail 17 is flown back to the fuel supplying passage 22 through the return passage 17*b* as the relief valve 17*a* opens.

(3) Control System

Figure 3:
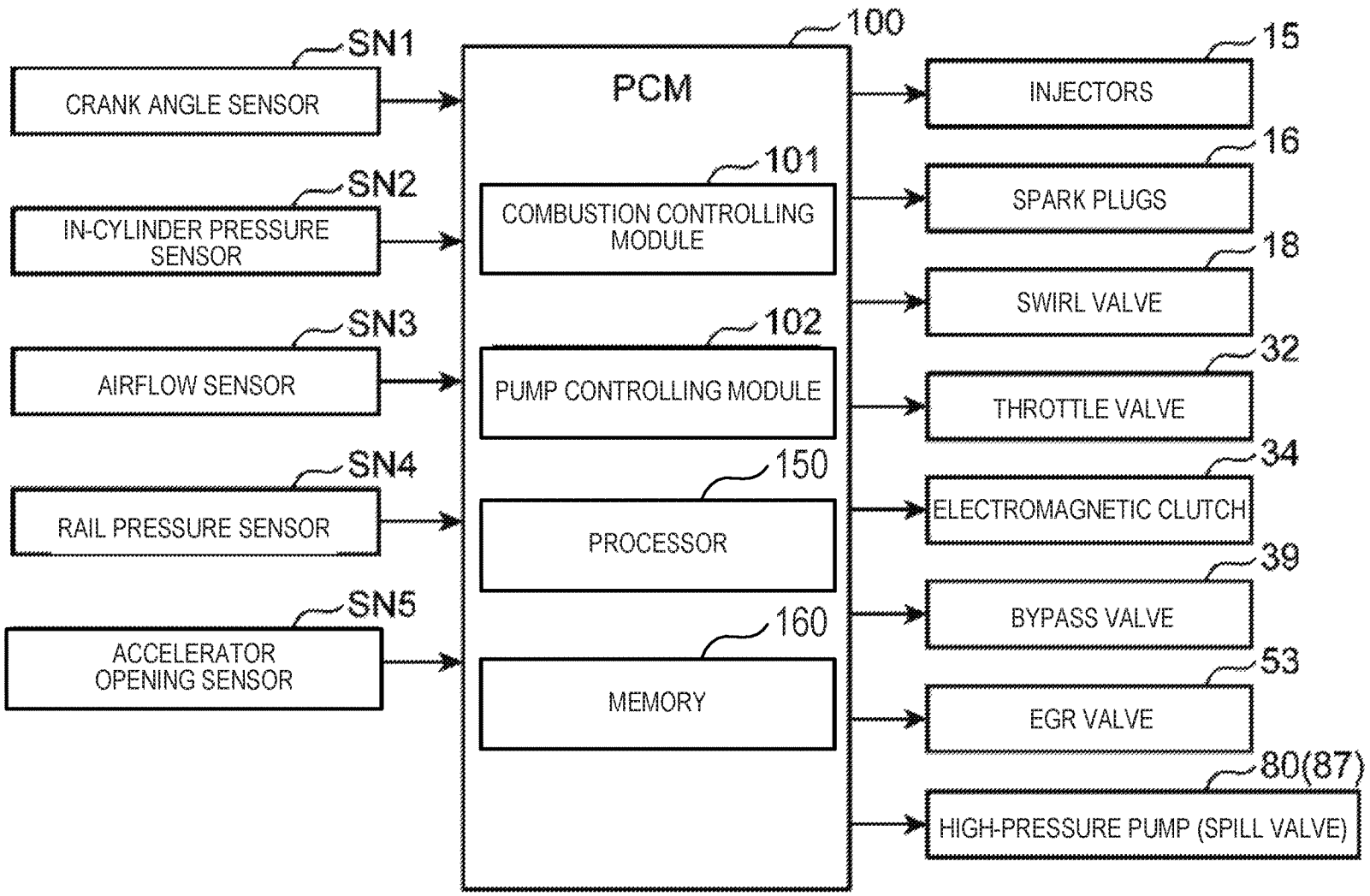
FIG. 3 is a block diagram illustrating a control system of the engine.

FIG. 3 is a block diagram illustrating a control system of the engine. A powertrain control module (PCM) 100 illustrated in FIG. 3 is a microcomputer which comprehensively controls the engine, and comprised of a well-known processor (e.g., a central processing unit (CPU) 150, and memory 160 (ROM and RAM).

The PCM 100 receives detection signals from various sensors. For example, the PCM 100 is electrically connected to the crank angle sensor SN1, the in-cylinder pressure sensor SN2, the airflow sensor SN3, and the rail pressure sensor SN4, which are described above. The PCM 100 sequentially receives information detected by these sensors (i.e., the crank angle, the engine speed, the in-cylinder pressure, the intake air amount, and the rail pressure). Moreover, the vehicle is provided with an accelerator opening sensor SN5 which detects an opening of an accelerator pedal controlled by a driver driving the vehicle, and a detection signal from the accelerator opening sensor SN5 is also inputted into the PCM 100.

The PCM 100 controls each component of the engine while executing various determinations and calculations based on the input signals from the sensors. The PCM 100 is electrically connected to the injectors 15, the spark plugs 16, the swirl valve 18, the throttle valve 32, the electromagnetic clutch 34, the bypass valve 39, the EGR valve 53, the spill valve 87 of the high-pressure pump 80 (in detail, a driving mechanism which drives the spill valve 87), and outputs control signals to these components based on the calculation results. The PCM 100 executes software modules to achieve their respective functions, including a combustion controlling module 101 which controls a combustion mode of the mixture gas in the combustion chamber 6 and a pump controlling module 102 which controls the high-pressure pump 80. These modules are stored in the memory 160 as software programs. The combustion controlling module 101 is an example of a "combustion controller," and the pump controlling module 102 is an example of a "pump controller" in the present disclosure.

(3-1) Combustion Control

Figure 4:
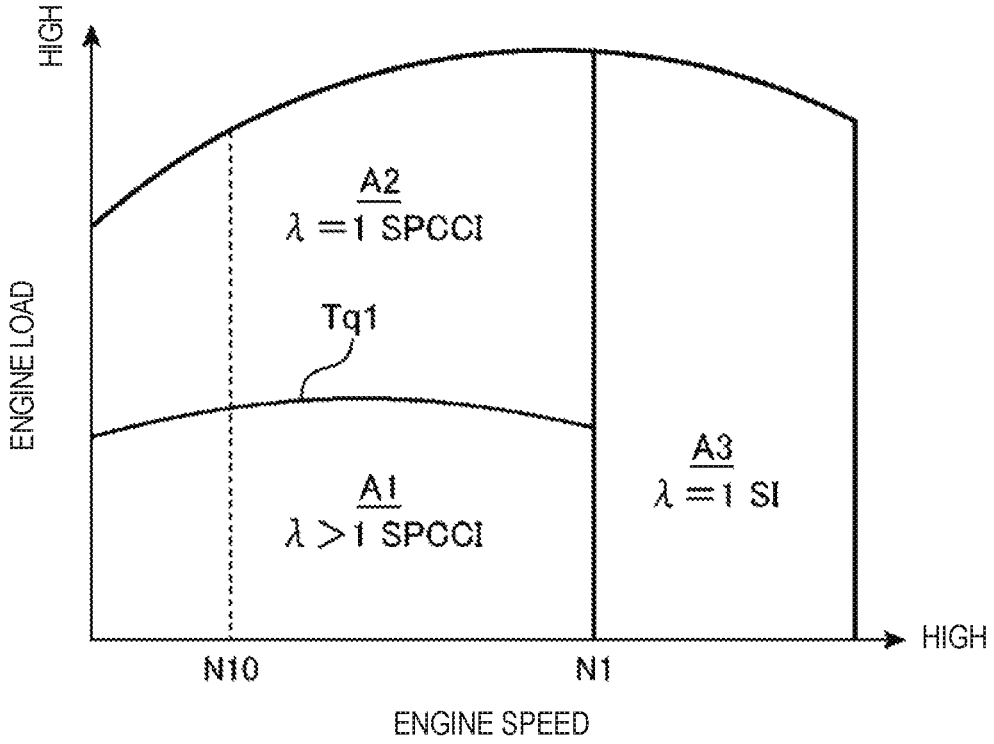
FIG. 4 is a map in which an operating range of the engine is divided according to a difference in a combustion mode.

FIG. 4 is a map in which a difference in a combustion control according to an engine speed and an engine load is illustrated. As illustrated in FIG. 4, an operating range of the engine is roughly divided into three operating ranges of a first operating range A1, a second operating range A2, and a third operating range A3. The first operating range A1 is a low-speed/low-load range in which the engine speed is below a given first speed N1, and the engine load is below a given first load Tq1. The second operating range A2 is a low-speed/high-load range in which the engine speed is below the first speed N1, and the engine load is higher than the first load Tq1. The third operating range A3 is a high-speed range in which the engine speed is higher than the first speed N1. The PCM 100 determines to which operating range the current operating point is included based on the engine speed and the engine load detected by the crank angle sensor SN1, and executes a given control set for each of the operating ranges (A1-A3). Note that the PCM 100 calculates the engine load based on the opening of the accelerator pedal detected by the accelerator opening sensor SN5, and the engine speed.

(a) First Operating Range A1 and Second Operating Range A2

In the first and second operating ranges A1 and A2, the PCM 100 (combustion controlling module 101) executes a partial compression-ignition combustion (hereinafter, referred to as "SPCCI combustion") in which spark ignition (SI) combustion and compression ignition (CI) combustion are combined. Note that "SPCCI" in the SPCCI combustion is an abbreviation for "SPark Controlled Compression Ignition."

The SI combustion is a mode in which the spark plug 16 ignites the mixture gas so as to forcibly combust the mixture gas by flame propagation which spreads a combusting range from an ignition point. The CI combustion is a mode in which the mixture gas is combusted by a self-ignition under an environment increased in the temperature and the pressure due to the compression of the piston 5. The SPCCI combustion combining the SI combustion and the CI combustion is a mode in which the SI combustion is performed on a portion of the mixture gas inside the combustion chamber 6 by a spark-ignition performed immediately before the mixture gas self-ignites, and after the SI combustion, the CI combustion is performed on the remaining mixture gas inside the combustion chamber 6 by the self-ignition (by the further increase in the temperature and the pressure accompanying the SI combustion).

Figure 5:
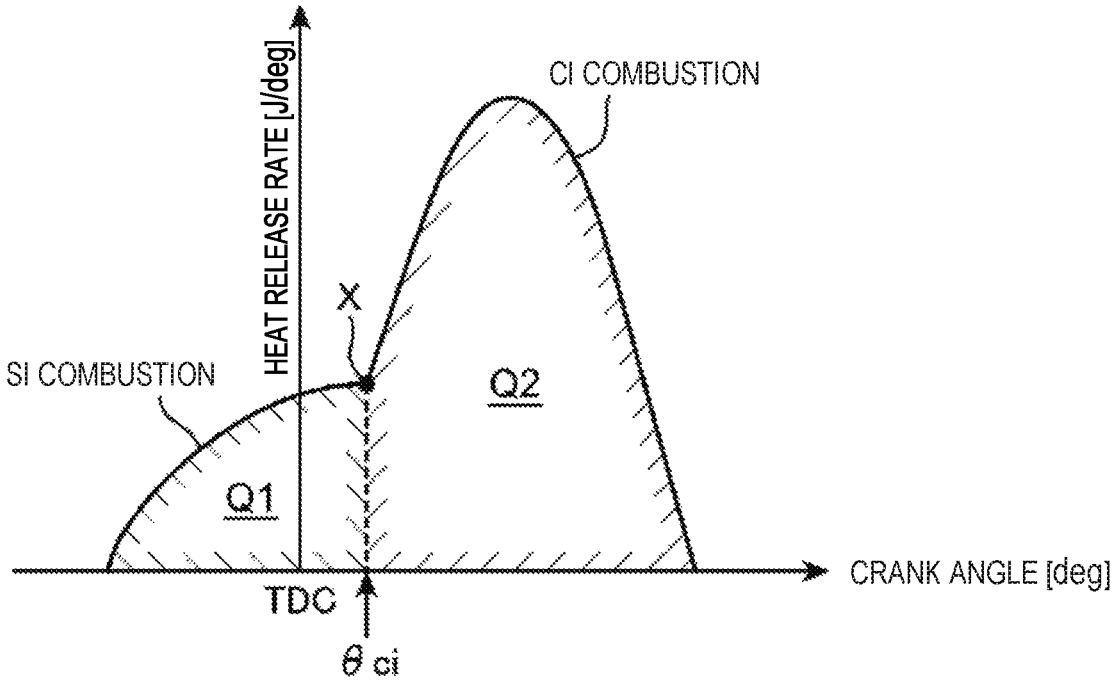
FIG. 5 is a chart illustrating a waveform of a heat release rate in SPCCI combustion (partial compression-ignition combustion).

FIG. 5 is a chart illustrating a change in a heat release rate (J/deg) with respect to the crank angle when the SPCCI combustion occurs. In the SPCCI combustion, the heat release becomes slower in the SI combustion than in the CI combustion. For example, as illustrated in FIG. 5, a waveform of the heat release rate when the SPCCI combustion is performed has a relatively shallow rising slope. Moreover, a pressure variation (i.e., dP/dθ: P is in-cylinder pressure and θ is a crank angle) inside the combustion chamber 6 also becomes shallower in the SI combustion than in the CI combustion. In other words, the waveform of the heat release rate in the SPCCI combustion is formed to have a first heat release rate portion (a portion indicated by Q1) formed by the SI combustion and having a relatively shallow rising slope, and a second heat release rate portion (a portion indicated by Q2) formed by the CI combustion and having a relatively sharp rising slope, which are next to each other in this order.

When the temperature and the pressure inside the combustion chamber 6 rise due to the SI combustion, unburnt mixture gas self-ignites, and therefore the CI combustion starts. As illustrated in FIG. 5, the slope of the waveform of the heat release rate changes from shallow to sharp at the timing of self-ignition (i.e., at the timing CI combustion starts). That is, the waveform of the heat release rate caused by the SPCCI combustion has a flection point at the timing θci when the CI combustion starts (indicated by an "X" in FIG. 5).

After the CI combustion starts, the SI combustion and the CI combustion are performed in parallel. In the CI combustion, since the heat release is larger than in the SI combustion, the heat release rate becomes relatively high. However, since the CI combustion is performed after TDC of the compression stroke (CTDC), the slope of the waveform of the heat release rate does not become excessive. That is, since motoring pressure decreases due to the descent of the piston 5 after CTDC, the rise in the heat release rate is prevented, which prevents dP/dθ in the CI combustion from becoming excessive. As described above, in the SPCCI combustion, since the CI combustion is performed after the SI combustion, dP/dθ which is an index of combustion noise is unlikely to be excessive, and thus, combustion noise can be reduced compared to performing the CI combustion alone (when the CI combustion is performed on all the fuel).

The SPCCI combustion ends as the CI combustion ends. Since a combustion speed is faster in the CI combustion than in the SI combustion, a combustion end timing is advanced compared to performing the SI combustion alone (when the SI combustion is performed on all the fuel). In other words, in the SPCCI combustion, the combustion end timing can be brought closer to CTDC in an expansion stroke. Therefore, the SPCCI combustion can improve fuel efficiency compared to performing the SI combustion alone.

(First Operating Range)

In the first operating range A1 where the SPCCI combustion is performed and the engine load is low, an air-fuel ratio (A/F) in the combustion chamber 6 is set higher (leaner) than the stoichiometric air-fuel ratio in order to improve fuel efficiency. That is, within the first operating range A1, the SPCCI combustion is performed with the air-fuel ratio of the mixture gas inside the combustion chamber 6 higher than the stoichiometric air-fuel ratio. The combustion mode performed in the first operating range A1 is an example of a "second combustion mode" of the present disclosure.

Within the first operating range A1, the injector 15 injects fuel into the combustion chamber 6 in an amount which brings the air-fuel ratio (A/F) in the combustion chamber 6 higher than the stoichiometric air-fuel ratio. For example, in the first operating range A1, the air-fuel ratio in the combustion chamber 6 is set to about 30:1 so that an amount of raw NOR, which is NOR generated in the combustion chamber 6, becomes sufficiently small. Note that λ in FIG. 4 indicates an excess air ratio. The excess air ratio λ=1 means that the air-fuel ratio in the combustion chamber 6 is the stoichiometric air-fuel ratio, and the excess air ratio λ>1 means that the air-fuel ratio in the combustion chamber 6 is higher than the stoichiometric air-fuel ratio.

Moreover, within the first operating range A1, the PCM 100 controls each component of the engine as follows in order to achieve the SPCCI combustion.

The injector 15 injects all or a major portion of fuel to be injected in one cycle on a compression stroke. The spark plug 16 ignites the mixture gas near CTDC. The valve operating mechanisms 13 and 14 open and close the intake valves 11 and the exhaust valves 12, respectively, so that a valve overlap in which both of the intake valve 11 and the exhaust valve 12 open over a top dead center of an exhaust stroke is achieved. When the valve overlap is achieved, internal EGR is performed, in which burnt gas at high temperature discharged to the intake passage 30 or the exhaust passage 40 is reintroduced into the combustion chamber 6 so that the burnt gas at high temperature remains in the combustion chamber 6. The throttle valve 32 is fully opened. The EGR valve 53 is opened to a given opening. The swirl valve 18 is fully closed, or narrowed to be nearly fully closed. In a low-engine speed side within the first operating range A1, the electromagnetic clutch 34 is disengaged so that the boosting by the supercharger 33 is suspended. In a high-engine speed side within the first operating range A1, the electromagnetic clutch 34 is engaged so that the supercharger 33 boosts the engine.

(Second Operating Range)

The second operating range A2 is a range in which the engine load is higher and the amount of fuel to be supplied into the combustion chamber 6 is larger than in the first operating range A1. Therefore, in the second operating range A2, it is difficult to increase the air-fuel ratio in the combustion chamber 6 until the amount of raw NO becomes sufficiently small. Thus, in the second operating range A2, the air-fuel ratio of exhaust gas, that is, the air-fuel ratio in the combustion chamber 6 is set to the stoichiometric air-fuel ratio so that the NO is purified by the three-way catalyst 41*a*.

Moreover, in the second operating range A2, the PCM 100 controls each component of the engine as follows in order to achieve the SPCCI combustion.

The injector 15 injects a portion of fuel to be injected in one cycle on an intake stroke, and injects the rest of the fuel on a compression stroke. The spark plug 16 ignites the mixture gas near CTDC. The valve operating mechanisms 13 and 14 open and close the intake valves 11 and the exhaust valves 12, respectively, so that the internal EGR is performed only in a partial range of the second operating range A2 on the low-engine load side. The throttle valve 32 is fully opened. The EGR valve 53 is controlled so that the amount of exhaust gas recirculated through the EGR passage 51 becomes smaller as the engine load increases. The swirl valve 18 is opened to be a suitable middle opening (other than a fully closed state and a fully opened state) and the opening is increased as the engine load increases. In a range where both of the engine speed and the engine load are low within the second operating range A2, the electromagnetic clutch 34 is disengaged so that the boosting by the supercharger 33 is suspended. On the other hand, in the other range within the second operating range A2, the electromagnetic clutch 34 is engaged so that the supercharger 33 boosts the engine.

(b) Third Operating Range A3

In the third operating range A3, comparatively orthodox SI combustion is performed. That is, the combustion mode of the mixture gas in the third operating range A3 is set as a mode where the SI combustion is performed. This combustion mode performed in the third operating range A3 is an example of a "first combustion mode" in the present disclosure. The PCM 100 controls each component of the engine as follows in order to achieve this SI combustion in the third operating range A3.

The injector 15 injects fuel over a given period of time which at least overlaps with an intake stroke. The spark plug 16 ignites the mixture gas near CTDC. In the third operating range A3, the SI combustion starts triggered by this ignition, and all the mixture gas inside the combustion chamber 6 combusts by flame propagation. The electromagnetic clutch 34 is engaged so that the supercharger 33 boosts the engine. The throttle valve 32 is fully opened. The opening of the EGR valve 53 is controlled so that the air-fuel ratio (A/F) in the combustion chamber 6 becomes the stoichiometric air-fuel ratio or slightly richer. The swirl valve 18 is fully opened.

(Control of High-Pressure Pump)

A control of the high-pressure pump 80 executed by the PCM 100 (pump controlling module 102) is described.

Figure 6:
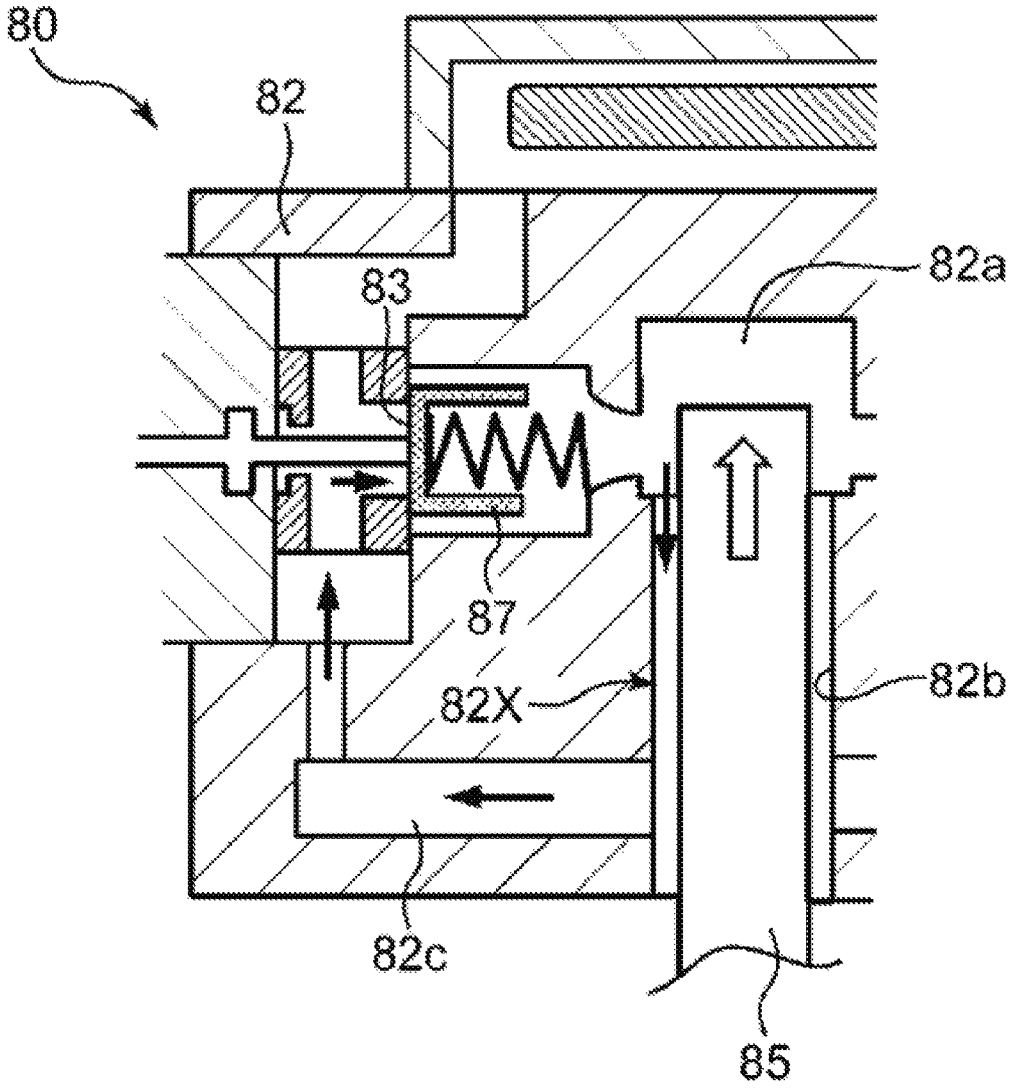
FIG. 6 is a partial enlarged view of FIG. 2.

Fuel pressurized in the pressurizing chamber 82*a* of the high-pressure pump 80 is basically pumped into the fuel rail 17. However, as illustrated in FIG. 6 which is a partial enlarged view of FIG. 2, a gap 82X exists between the plunger sliding part 82*b* and the plunger 85. Therefore, as indicated by arrows in FIG. 6, a portion of fuel leaks outside the pressurizing chamber 82*a* through the gap 82X while being pressurized in the pressurizing chamber 82*a*, and then the leaked fuel is reintroduced into the pressurizing chamber 82*a*. In detail, the body part 82 of the high-pressure pump 80 is provided with a fuel receiving passage 82*c* communicating with the gap 82X, and this fuel receiving passage 82*c* communicates with the pressurizing chamber 82*a* via the suction port 83. Accordingly, a portion of fuel pressurized in the pressurizing chamber 82*a* is reintroduced into the pressurizing chamber 82*a* through the gap 82X, the fuel receiving passage 82*c*, and the suction port 83.

The temperature of fuel leaked from the pressurizing chamber 82*a* to the gap 82X is raised in the pressurizing chamber 82*a*, and also raised by friction heat while passing through the gap 82X. Therefore, when fuel is reintroduced into the pressurizing chamber 82*a* and pressurized again, the temperature of the fuel inside the pressurizing chamber 82*a* becomes excessively high, that is, the fuel temperature may rise excessively. When the temperature of fuel rises excessively, vapor (bubbles) may be generated in the fuel, and thus, a suitable amount of fuel may not be supplied to the fuel rail 17 and to the injector 15.

Regarding to this, by reducing a frequency of fuel being pressurized inside the pressurizing chamber 82*a*, a frequency of fuel increased in the pressure and the temperature being reintroduced into the pressurizing chamber 82*a* through the gap 82X is reduced, which can prevent the excessive rise in the temperature of fuel.

Therefore, it can be considered to control the high-pressure pump 80 so that the frequency of fuel being pressurized in the pressurizing chamber 82*a* is reduced. In detail, it can be considered that, by increasing a ratio of a closing cycle of the spill valve 87 (a period from a start of closing the spill valve 87 to the next start of closing the spill valve 87) to the pressurizing cycle of the high-pressure pump 80, and closing the spill valve 87 intermittently with respect to the executing timing the pressurizing stroke, the frequency of fuel being pressurized inside the pressurizing chamber 82*a* is reduced. However, when the frequency of fuel being pressurized inside the pressurizing chamber 82*a* is reduced, a variation width of rail pressure increases due to degradation in an accuracy of controlling the rail pressure. Thus, a deviation of the injection pressure of the injector 15 (a pressure of fuel injected from the injector 15) from an optimal value increases.

Figure 7:
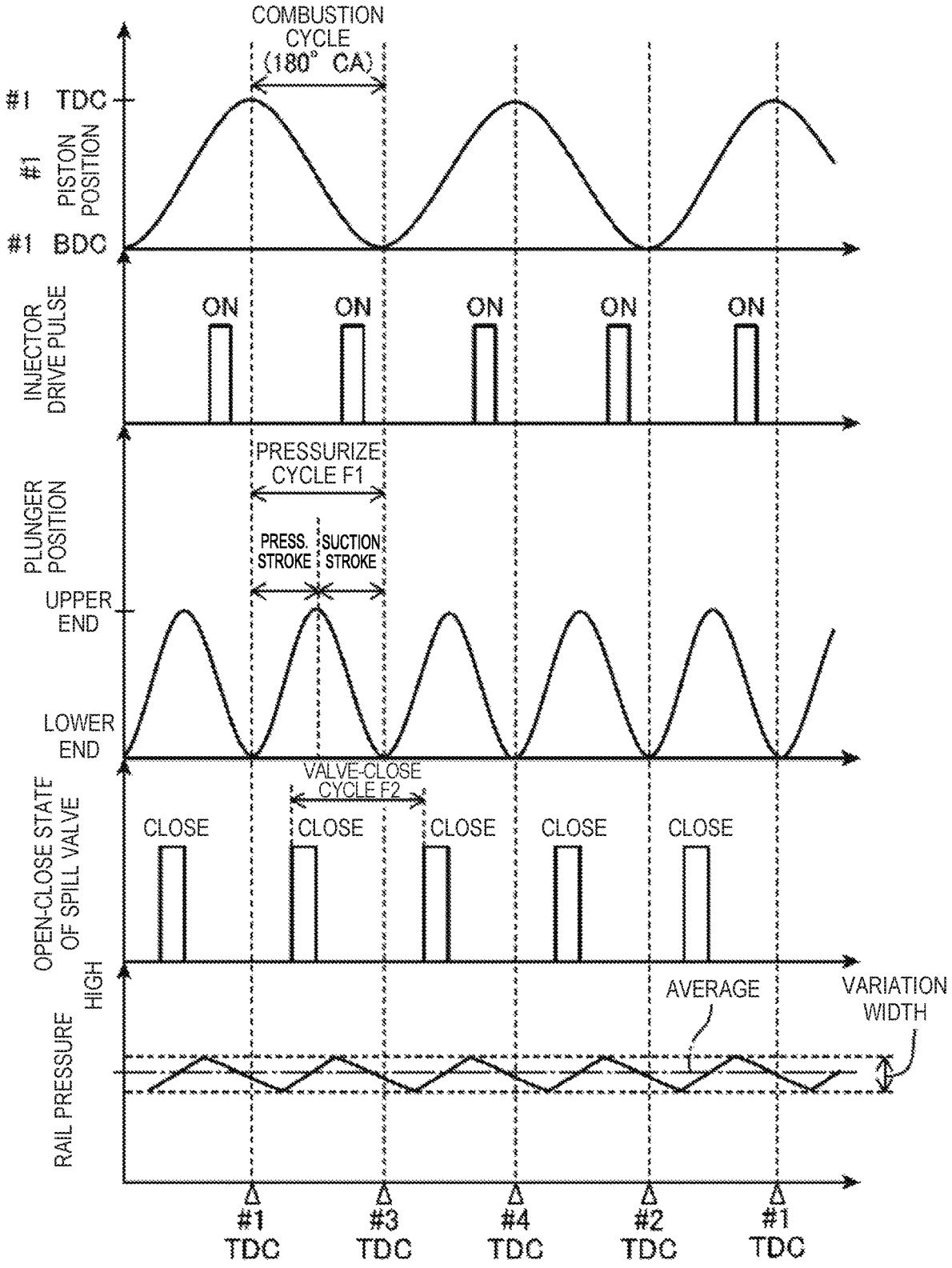
FIG. 7 is a timechart schematically illustrating a temporal change of each parameter when a valve-closing pressurizing ratio is 1:1.
Figure 8:
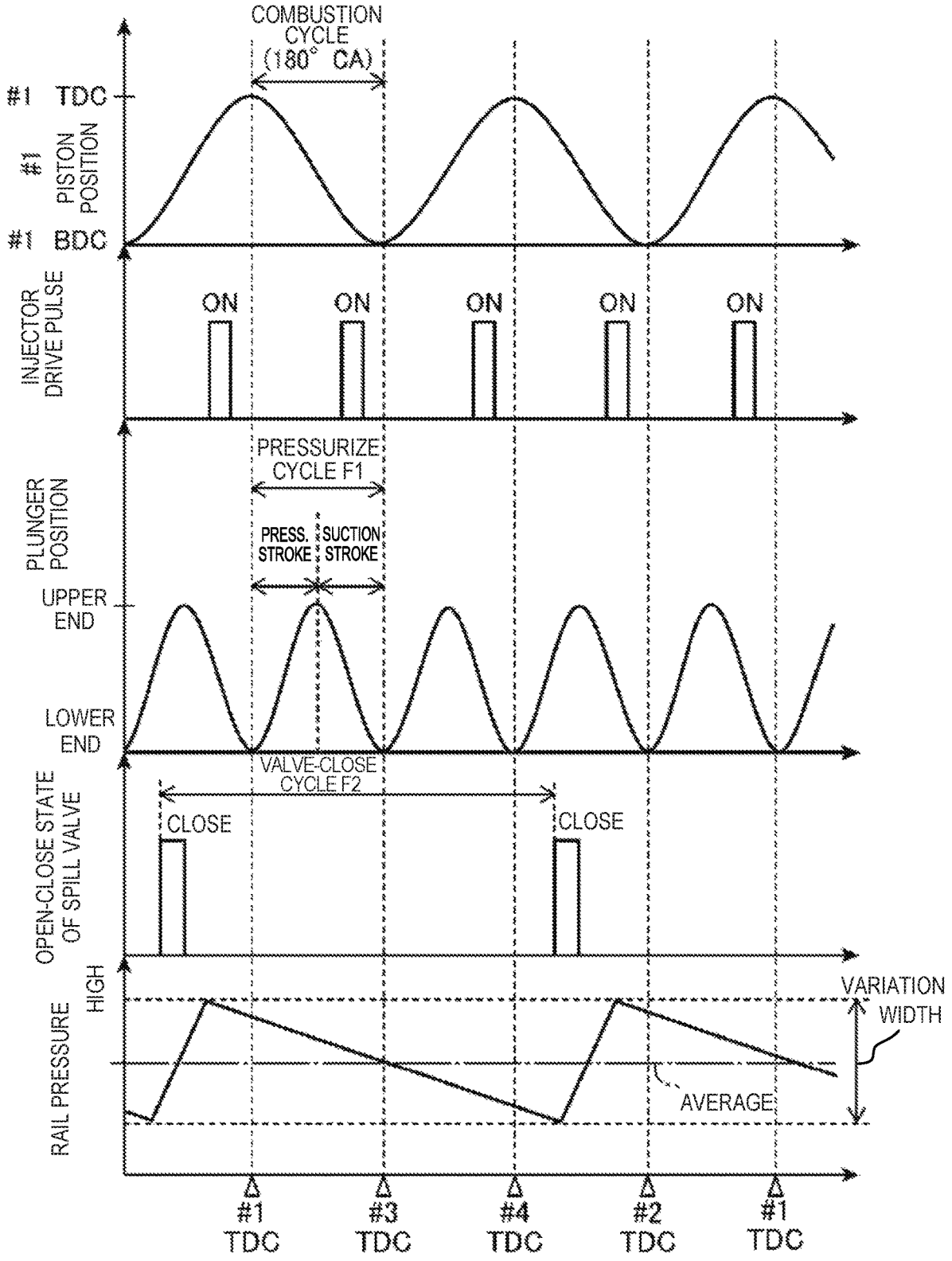
FIG. 8 is a timechart schematically illustrating a temporal change of each parameter when the valve-closing pressurizing ratio is 3:1.

Detailed description is given referring to FIGS. 7 and 8. FIGS. 7 and 8 are views schematically illustrating a temporal change of each parameter related to the high-pressure pump 80. Charts in FIGS. 7 and 8 indicate, from the top, a position of the piston 5 in the first cylinder, a drive pulse of each injector 15, the position of the plunger 85, the open-close state of the spill valve 87, and the rail pressure. Note that in FIGS. 7 and 8, a case where the injector 15 is driven once in a latter half of a compression stroke is illustrated for the sake of simplicity. Moreover, phases of the piston 5 and the plunger 85 in FIGS. 7 and 8 are one example, and a phase difference between the piston 5 and the plunger 85 is not limited to the one illustrated in FIGS. 7 and 8. Further, in FIGS. 7 and 8, #1TDC, #2TDC, #3TDC, and #4TDC indicate CTDCs of the first cylinder, the second cylinder, the third cylinder, and the fourth cylinder, respectively.

FIG. 7 is a view illustrating a case where the ratio of the closing cycle of the spill valve 87 to the pressurizing cycle of the high-pressure pump 80 is small, while FIG. 8 is a view illustrating a case where this ratio is large. Hereinafter, the ratio of the closing cycle of the spill valve 87 to the pressurizing cycle of the high-pressure pump 80 is referred to as a "valve-closing pressurizing ratio."

In the pattern of FIG. 7, the valve-closing pressurizing ratio is set to 1:1 in which the closing cycle of the spill valve 87 (valve-close cycle F2) and the pressurizing cycle of the high-pressure pump 80 (pressurize cycle F1) are the same, and the spill valve 87 is closed once in every pressurizing stroke of the high-pressure pump 80. On the other hand, in the pattern of FIG. 8, the valve-closing pressurizing ratio is set to 3:1 in which the closing cycle of the spill valve 87 (valve-close cycle F2) is set three times longer than the pressurizing cycle of the high-pressure pump 80 (pressurize cycle F1). Thus, the spill valve 87 is closed only once in every three pressurizing strokes of the high-pressure pump 80.

As described above, fuel inside the pressurizing chamber 82*a* and in the fuel rail 17 are pressurized when the high-pressure pump 80 is on the pressurizing stroke and when the spill valve 87 is closed. Therefore, in the pattern of FIG. 7, fuel is pressurized in a same cycle as the pressurizing cycle of the high-pressure pump 80, while in the pattern of FIG. 8, fuel is pressurized in a cycle three times longer than the pressurizing cycle of the high-pressure pump 80. Accordingly, in the pattern of FIG. 8 in which the valve-closing pressurizing ratio is larger, the frequency of fuel being pressurized is reduced compared to the pattern in FIG. 7 in which the valve-closing pressurizing ratio is smaller.

Accordingly, by increasing the valve-closing pressurizing ratio, the frequency of fuel being pressurized can be reduced. Moreover, the amount of fuel which leaks from the gap 82X can be reduced so that the rise in the fuel temperature is prevented.

However, when the valve-closing pressurizing ratio is increased and the closing cycle of the spill valve 87 is made longer, the number of fuel injections from the injector 15 during one closing cycle of the spill valve 87 increases. Thus, the variation amount of the rail pressure increases. In detail, as illustrated in FIGS. 7 and 8, the rail pressure increases as the spill valve 87 starts closing on a pressurizing stroke. Then, the rail pressure decreases when fuel inside the fuel rail 17 is injected into the combustion chamber 6 by the injector 15. Therefore, when the closing cycle of the spill valve 87 is made longer, and the injector 15 injects fuel multiple times before the next closing of the spill valve 87, a decreasing amount of the rail pressure becomes large.

As described above, by increasing the closing period of the spill valve 87 (a period from the start of closing to the start of opening), the pressurizing amount of fuel in every closing period increases. Therefore, even when the valve-closing pressurizing ratio is large, by increasing the closing period of the spill valve 87, a time average value of the rail pressure can be maintained at the same level as a time average value of the rail pressure when the valve-closing pressurizing ratio is small.

However, when the variation amount of the rail pressure is large, maintaining an appropriate injection pressure for all the injectors 15 becomes difficult. Therefore, it becomes difficult to maintain, in all the combustion chambers 6, appropriate states of properties of injected fuel spray (e.g., a particle size, penetration) and gas flows formed inside the combustion chambers 6.

Here, in the SPCCI combustion where a portion of the mixture gas self-ignites, combustion stability is lower than in the SI combustion where the mixture gas is forcibly combusted. In detail, the timing when the mixture gas self-ignites easily varies due to the changes in the state of the mixture gas and the gas flow inside the combustion chamber 6. Therefore, the appropriate SPCCI combustion is difficult to be achieved when the state of the mixture gas deviates from the appropriate state. Especially in the first operating range A1, since the air-fuel ratio of the mixture gas is set larger (leaner) than the stoichiometric air-fuel ratio, the combustion stability is easily lowered. Therefore, in the first operating range A1, if the properties of the fuel spray and the gas flow deviate from the appropriate states, the mixture gas may not self-ignite at an appropriate timing. Thereby, the appropriate SPCCI combustion may not be achieved, and thus, a decrease in the engine torque and an increase in the combustion noise may be caused.

Regarding to this, in the first operating range A1 of this embodiment, the valve-closing pressurizing ratio is set small so that the variation amount of the rail pressure is maintained small. On the other hand, in the other operating ranges (the second and third operating ranges A2 and A3), the valve-closing pressurizing ratio is set large so that the excessive rise in the fuel temperature is prevented.

Note that in the first operating range A1, since the engine speed is low, fuel is rarely pressurized by the high-pressure pump 80 in the first place. Moreover, in the first operating range A1, since the engine load is low and the amount of fuel injected from the injector 15 is small, the pressurizing amount of fuel by the high-pressure pump 80 is small. Accordingly, in the first operating range A1, the amount of fuel reintroduced into the pressurizing chamber 82*a* through the gap 82X is small. Therefore, the excessive rise in the fuel temperature is difficult to occur in the first operating range A1.

As described above, the variation amount of the rail pressure becomes small when the valve-closing pressurizing ratio is set small. Therefore, by controlling the spill valve 87 such that the variation amount of the rail pressure becomes small, the valve-closing pressurizing ratio also becomes small. Thus, in this embodiment, target values of the variation width of the rail pressure are set for respective operating conditions, and the spill valve 87 is driven so that the variation width of the rail pressure becomes the target value. Then, by making the target value of the variation width in the first operating range A1 smaller than the target values in the other operating ranges (the second and third operating ranges A2 and A3), the valve-closing pressurizing ratio in the first operating range A1 is made smaller than those in the other operating ranges A2 and A3.

Figure 9:
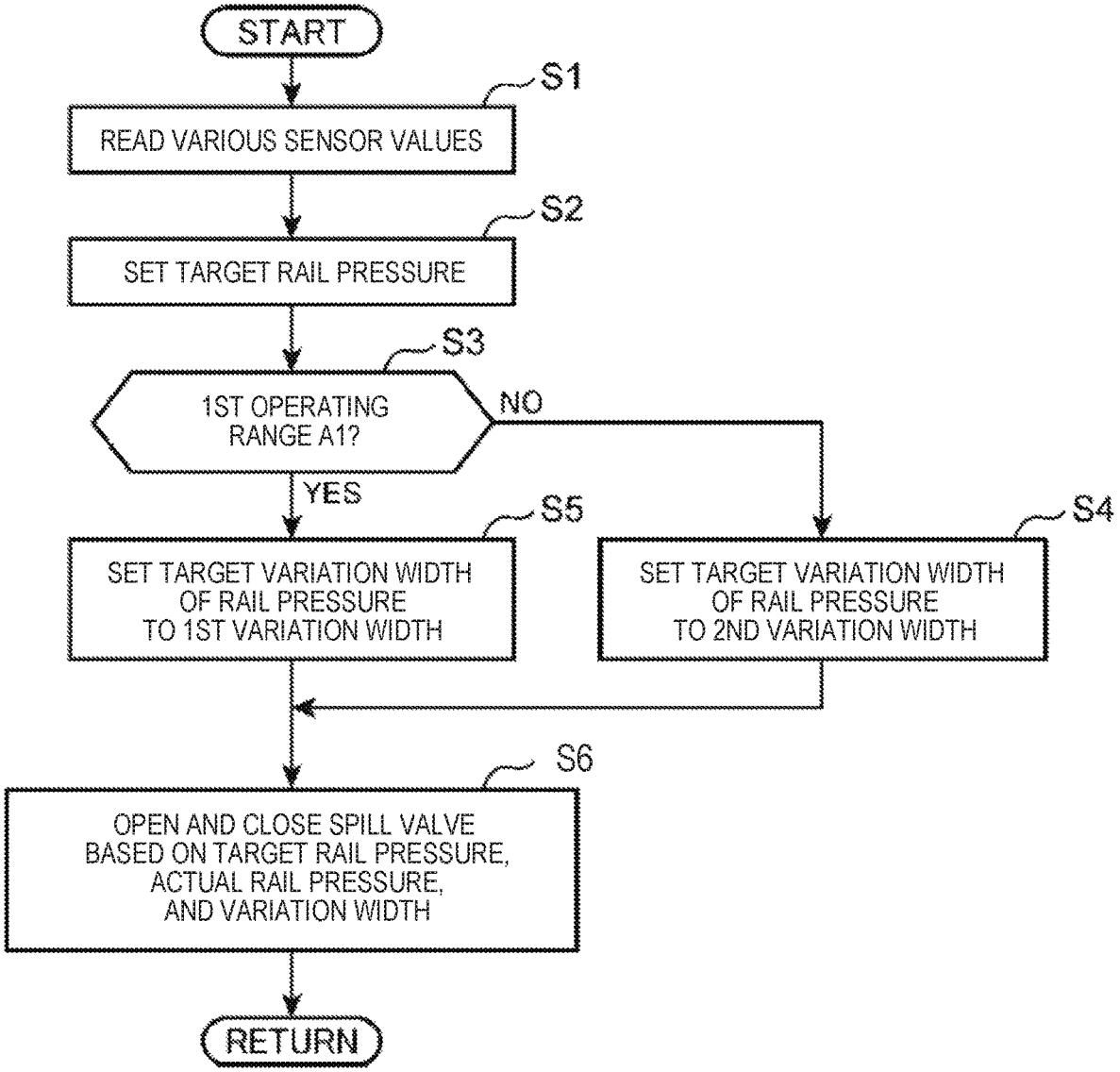
FIG. 9 is a flowchart illustrating a control procedure of the high-pressure pump.

A control of the rail pressure executed by the PCM 100 is described with reference to FIG. 9.

At Step S1, the PCM 100 reads the detection values from the various sensors.

Next, at Step S2, the PCM 100 sets a target rail pressure which is a target value of the rail pressure based on the operating state of the engine. For example, the target rail pressure is set in advance regarding the engine speed and the engine load, and stored as a map in the PCM 100. The PCM 100 extracts a value corresponding to the current engine speed and the engine load from the map.

Next, at Step S3, the PCM 100 determines whether the engine is operated in the first operating range A1. In detail, the PCM 100 determines that the current operating point of the engine is included in the first operating range A1, and the engine is operated in the first operating range A1, when the current engine speed is below the first speed N1, and the current engine load is below the first load Tq1.

When the determination at Step S3 is NO, and the engine is not operated in the first operating range A1, that is, when the engine is operated in the second operating range A2 or the third operating range A3, the PCM 100 shifts to Step S4. At Step S4, the PCM 100 sets the target variation width which is the target value of the variation width of the rail pressure, to a given second variation width. The second variation width is set to a fixed value regardless of the engine speed and the engine load, and stored in the PCM 100. For example, the second variation width is set to about 5 MPa.

Figure 10:
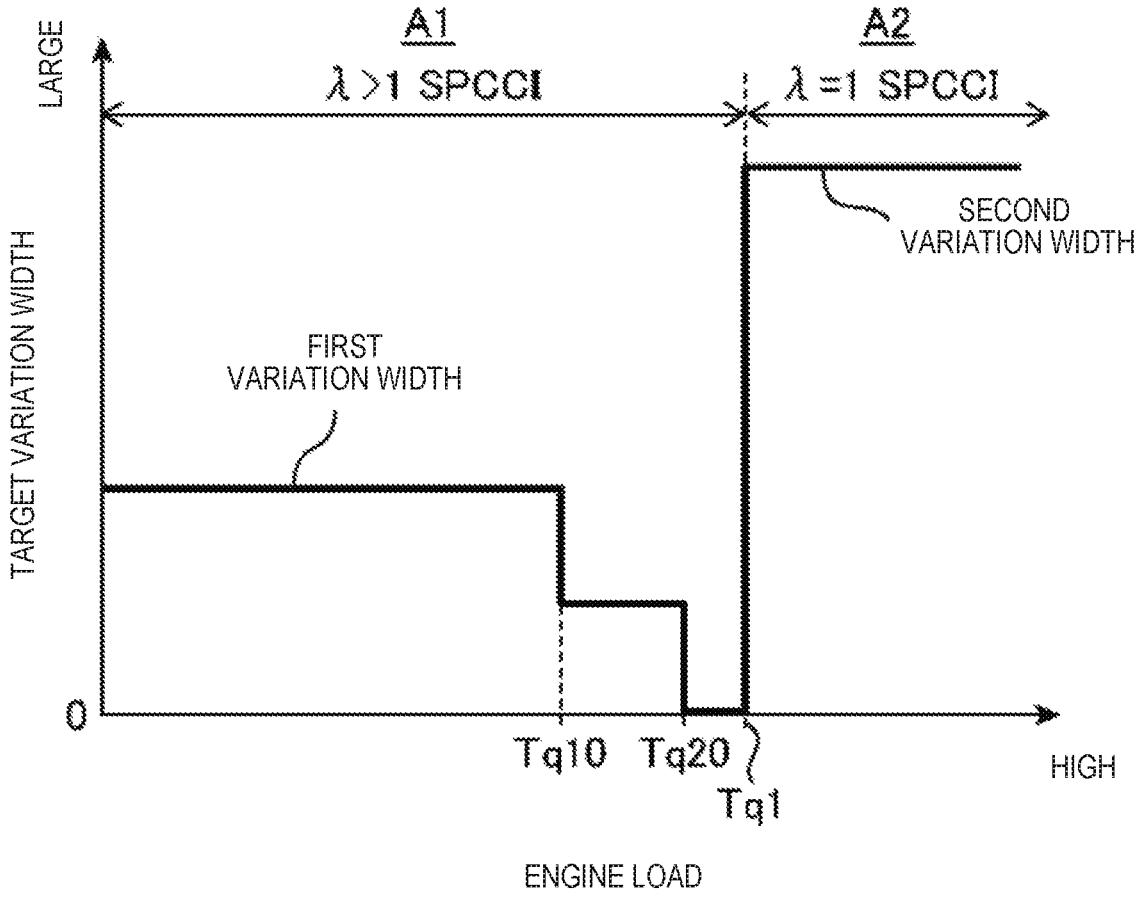
FIG. 10 is a graph illustrating a relationship between an engine load and a target variation width.

On the other hand, when the determination at Step S3 is YES, and the engine is operated in the first operating range A1, the PCM 100 shifts to Step S5. At Step S5, the PCM 100 sets the target variation width to a first variation width which is smaller than the second variation width. FIG. 10 is a graph illustrating a relationship between the engine load and the first variation width when the engine speed is maintained at a given speed N10 included in the first operating range A1. As illustrated in FIG. 10, in the first operating range A1, the first variation width is set so that the variation width becomes smaller as the engine load increases in order to reduce the amount of $NO_x$ emission. In the example of FIG. 10, the first variation width is set to be different between a range where the engine load is lower than a given load Tq10, a range where the engine load is between the load Tq10 and a given load Tq20 which is higher than the load Tq10, and a range where the engine load is higher than the load Tq20. For example, the first variation width is set to a value within a range between approximately 0-2 MPa.

After Step S4 or Step S5, the PCM 100 shifts to Step S6. At Step S6, the PCM 100 opens and closes the spill valve 87 based on an actual rail pressure read at Step S1, so that the actual rail pressure becomes the target rail pressure, and the variation width of the rail pressure becomes the target variation width set at Step S4 or Step S5.

For example, the PCM 100 calculates a value by adding half the value of the target variation width to the target rail pressure, as a maximum target rail pressure. Then, the PCM 100 calculates the closing period of the spill valve 87 based on a difference between the actual rail pressure and the maximum target rail pressure. That is, the PCM 100 performs a feedback control of the closing period of the spill valve 87 so that the actual rail pressure becomes the maximum target rail pressure. Moreover, the PCM 100 prohibits the closing (maintains the opening) of the spill valve 87 until the actual rail pressure drops to a value obtained by subtracting half the value of the target variation width from the target rail pressure. When the actual rail pressure becomes below the value obtained by subtracting half the value of the target variation width from the target rail pressure, the PCM 100 allows the closing of the spill valve 87.

Here, the rail pressure decreases as the injector 15 injects fuel. Therefore, it is difficult to bring the target variation width to accurately zero, and thus the PCM 100 opens and closes the spill valve 87 so that the variation width becomes the closest to the target variation width. That is, the phrase "to control the spill valve 87 so that the variation width of the rail pressure becomes the target variation width" used herein includes "to control the spill valve 87 so that the variation width becomes the closest to the target variation width." In addition, when the target variation width is set to 0 MPa, the closing of the spill valve 87 is allowed immediately after the injection of fuel from the injector 15, and the spill valve 87 opens every time the pressurizing stroke of the high-pressure pump 80 is performed.

As described above, in the first operating range A1 of this embodiment, the spill valve 87 is opened and closed so that the variation width of the rail pressure becomes small. On the other hand, in the second and third operating ranges A2 and A3, the spill valve 87 is opened and closed so that the variation width of the rail pressure becomes large, and the valve-closing pressurizing ratio becomes large so as to reduce the frequency of fuel being pressurized.

Figure 11:
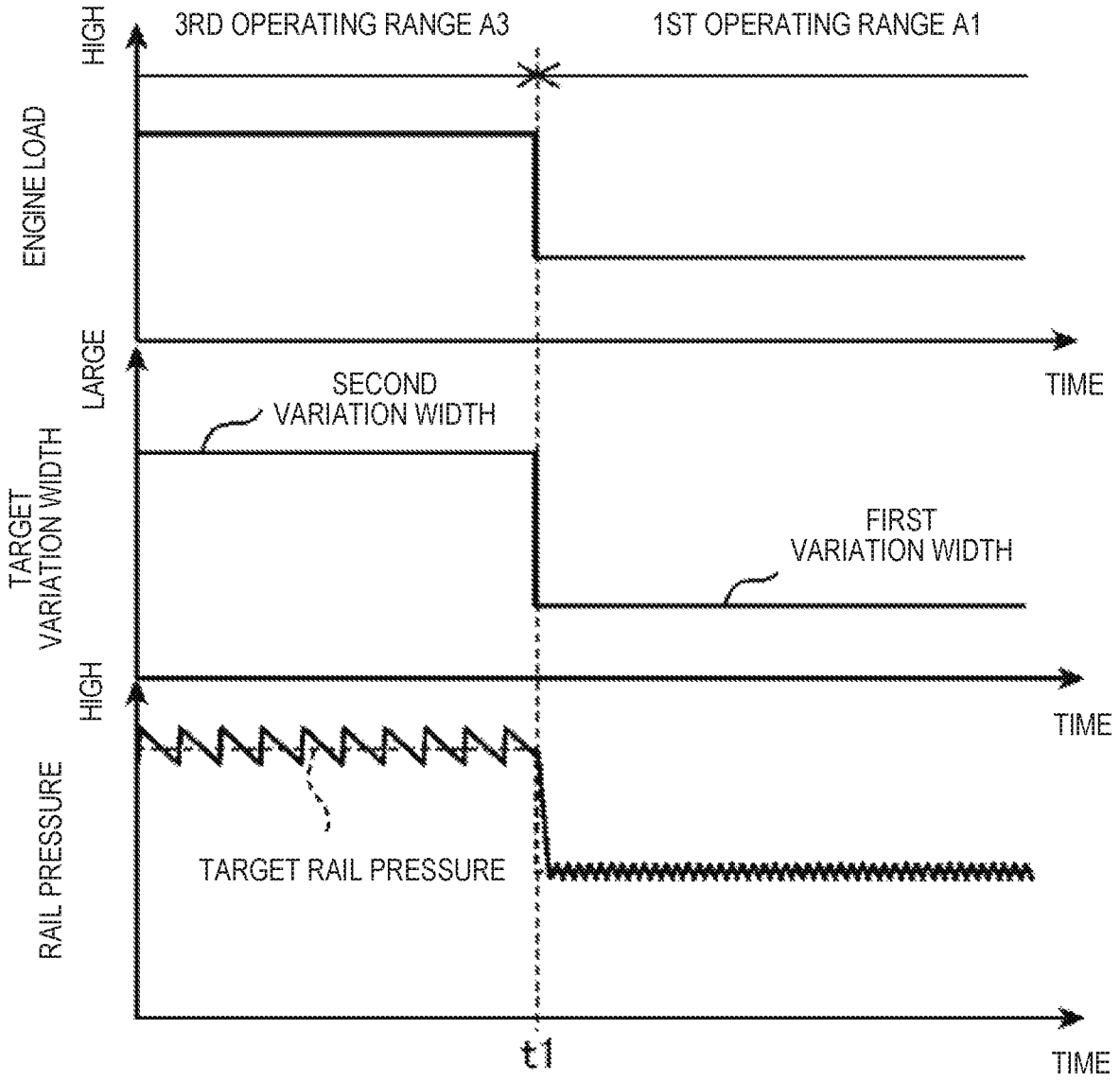
FIG. 11 is a timechart schematically illustrating a temporal change of each parameter when an operating point changes.

FIG. 11 is a timechart illustrating a temporal change of each parameter when the engine operating point shifts from a point within the third operating range A3 to a point within the first operating range A1, following a decrease in the engine load. Charts in FIG. 11 indicate, from the top, the engine load, the target variation width, and the rail pressure.

Since the engine is operated in the third operating range A3 until a time point t1, the target variation width of the rail pressure is set to the second variation width which is comparatively large. Therefore, until the time point t1, the rail pressure fluctuates comparatively largely having the target rail pressure at the center. On the other hand, after the operating point of the engine shifts to the point within the first operating range A1 at the time point t1, the target variation width of the rail pressure is decreased, and the rail pressure is controlled to be a value closer to the target rail pressure compared to in the third operating range A3.

(4) Effects

As described above, in this embodiment, the closing cycle of the spill valve 87 is controlled so that the valve-closing pressurizing ratio (the ratio of the closing cycle of the spill valve 87 to the pressurizing cycle of the high-pressure pump 80) becomes smaller when the engine is operated in the first operating range A1 where the SPCCI combustion with the air-fuel ratio of the mixture gas larger (leaner) than the stoichiometric air-fuel ratio is performed, compared to when the engine is operated in the third operating range A3 where the SI combustion is performed. Thus, in the SI combustion, the frequency of the spill valve 87 being closed and the frequency of fuel being pressurized are reduced so as to prevent the excessive rise in the fuel temperature. In addition, in the SPCCI combustion with the air-fuel ratio of the mixture gas leaner than the stoichiometric air-fuel ratio, the frequency of the spill valve 87 being closed and the frequency of fuel being pressurized are increased so as to improve the accuracy of controlling the injection pressure of the injector 15 and to maintain the injection pressure at the appropriate value. Therefore, the appropriate SPCCI combustion with the air-fuel ratio of the mixture gas larger (leaner) than the stoichiometric air-fuel ratio can be achieved, which can certainly improve fuel efficiency.

Moreover, in this embodiment, the target variation width which is the target value of the variation width of the rail pressure is set, and the spill valve 87 is controlled so that the variation width of the rail pressure becomes the target variation width. The target variation width is set to be smaller when the engine is operated in the first operating range A1 compared to when the engine is operated in the other operating ranges (A2 and A3).

Therefore, in the first operating range A1, the injection pressure of the injector 15 can be brought to the appropriate pressure more certainly. Moreover, in the second and third operating ranges A2 and A3, the valve-closing pressurizing ratio can be made small, and therefore, the excessive rise in the fuel temperature can be prevented.

Here, when the engine is operated in the first operating range A1, it is known that a change in the amount of $NO_x$ emitted from the engine relative to the change in the injection pressure of the injector 15 becomes larger as the engine load increases. Regarding to this, in this embodiment, the target variation width when the engine is operated in the first operating range A1 (first variation width) is set to be smaller as the engine load increases. Therefore, an increase in the amount of the $NO_x$ emission can be prevented in the higher-engine load side of the first operating range A1, while in the lower-engine load side, the frequency of the spill valve 87 being closed is reduced (within a range more than those in the second and third operating ranges A2 and A3) so that the excessive rise in the fuel temperature can be prevented.

(5) Modifications

In this embodiment, the target value of the variation width of the rail pressure is set, and the spill valve 87 is opened and closed to achieve the target value, so that the valve-closing pressurizing ratio becomes smaller when the engine is operated in the first operating range A1 than in the other operating ranges (A2 and A3). However, the target value of the valve-closing pressurizing ratio may be set for each of the first to third operating ranges A1 to A3, and the spill valve 87 may be opened and closed to achieve the target value.

Moreover, in this embodiment, although the target variation widths are set as same in the second and third operating ranges A2 and A3, the target variation width in the second operating range A2 where the SPCCI combustion is performed, may be set smaller than that in the third operating range A3.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Engine Body
2 Cylinder
15 Injector (Fuel Injector)
17 Fuel Rail (Fuel Storage)
22*a* Low-pressure Fuel Passage

80 High-pressure Pump (Fuel Pump)
82 Body Part
81 High-pressure Pump Cam (Plunger Driving Part)
82*a* Pressurizing Chamber
83 Suction Port
85 Plunger
87 Spill Valve (On-off Valve)
100 PCM
101 Combustion Controlling Module (Combustion Controller)
102 Pump Controlling Module (Pump Controller)

What is claimed is:

1. A control device for controlling an engine provided with a fuel injector configured to inject fuel into a cylinder, a spark plug configured to ignite a mixture gas inside the cylinder, a fuel storage configured to store fuel to be introduced into the fuel injector, a fuel pump configured to pump fuel into the fuel storage, and a low-pressure fuel passage through which fuel to be introduced into the fuel pump flows, the control device comprising:

a processor configured to execute:

a combustion controller to switch a combustion mode of the mixture gas between a first combustion mode and a second combustion mode by controlling each component of the engine according to an operating state of the engine; and a pump controller to control the fuel pump, wherein in the first combustion mode, the mixture gas is combusted by SI combustion where the spark plug ignites the mixture gas, and in the second combustion mode, a portion of the mixture gas is combusted by spark ignition (SI) combustion where the spark plug ignites the mixture gas, and then the remaining mixture gas is combusted by compression ignition (CI) combustion where the mixture gas is combusted by self-ignition, wherein the fuel pump includes:

a pressurizing chamber having a suction port, and into which fuel is introduced from the low-pressure fuel passage via the suction port;

a plunger inserted into the pressurizing chamber and configured to change a volume of the pressurizing chamber;

an on-off valve configured to open and close the suction port; and a plunger driving part configured to drive the plunger interlocking with the engine so that a suction stroke in which the volume of the pressurizing chamber is increased to allow fuel to be drawn into the pressurizing chamber, and a pressurizing stroke in which the volume of the pressurizing chamber is reduced to allow fuel inside the pressurizing chamber to be pressurized, are performed successively, and wherein when assuming that a period of time combining a period of the pressurizing stroke and a period of the suction stroke is a pressurizing cycle, the pump controller cyclically closes the on-off valve, and controls a closing cycle of the on-off valve so that a ratio of the closing cycle of the on-off valve to the pressurizing cycle becomes smaller in the second combustion mode than in the first combustion mode.

2. The control device of claim 1, wherein the combustion controller controls the fuel injector so that an air-fuel ratio of mixture gas in the second combustion mode becomes larger than a stoichiometric air-fuel ratio.

3. The control device of claim 1, wherein the pump controller sets a target variation width that is a target value for a variation width of fuel pressure inside the fuel storage, and controls the closing cycle of the on-off valve so that the variation width becomes the target variation width, and wherein the target variation width is set to a smaller value in the second combustion mode than in the first combustion mode.

4. The control device of claim 3, wherein in the second combustion mode, the target variation width is set to a smaller value as an engine load increases.

5. A method for controlling an engine provided with a fuel injector configured to inject fuel into a cylinder, a spark plug configured to ignite a mixture gas inside the cylinder, a fuel storage configured to store fuel to be introduced into the fuel injector, a fuel pump configured to pump fuel into the fuel storage, and a low-pressure fuel passage through which fuel to be introduced into the fuel pump flows, the method comprising the steps of:

switching a combustion mode of mixture gas between a first combustion mode and a second combustion mode by controlling each component of the engine according to an operating state of the engine; and controlling the fuel pump, wherein in the first combustion mode, mixture gas is combusted by SI combustion where the spark plug ignites the mixture gas, and in the second combustion mode, a portion of mixture gas is combusted by spark ignition (SI) combustion where the spark plug ignites the mixture gas, and then the rest of the mixture gas is combusted by compression ignition (CI) combustion where the mixture gas is combusted by self-ignition, wherein the fuel pump includes:

a pressurizing chamber having a suction port, and into which fuel is introduced from the low-pressure fuel passage via the suction port;

a plunger inserted into the pressurizing chamber and configured to change a volume of the pressurizing chamber;

an on-off valve configured to open and close the suction port; and a plunger driving part configured to drive the plunger interlocking with the engine so that a suction stroke in which the volume of the pressurizing chamber is increased to allow fuel to be drawn into the pressurizing chamber, and a pressurizing stroke in which the volume of the pressurizing chamber is reduced to allow fuel inside the pressurizing chamber to be pressurized, are performed successively, and wherein when assuming that a period of time combining a period of the pressurizing stroke and a period of the suction stroke is a pressurizing cycle, the on-off valve is cyclically closed, and a closing cycle of the on-off valve is controlled so that a ratio of the closing cycle of the on-off valve to the pressurizing cycle becomes smaller in the second combustion mode than in the first combustion mode.

* * * * *